US011388974B2

(12) United States Patent
Fearing

(10) Patent No.: US 11,388,974 B2
(45) Date of Patent: Jul. 19, 2022

(54) SHAVING MIRROR BASE

(71) Applicant: Daniel Fearing, Glendale, CA (US)

(72) Inventor: Daniel Fearing, Glendale, CA (US)

( * ) Notice: Subject to any disclaimer, the term of this patent is extended or adjusted under 35 U.S.C. 154(b) by 99 days.

(21) Appl. No.: 16/391,304

(22) Filed: Apr. 23, 2019

(65) Prior Publication Data

US 2020/0337442 A1 Oct. 29, 2020

(51) Int. Cl.
*A45D 42/08* (2006.01)

(52) U.S. Cl.
CPC ..... *A45D 42/08* (2013.01); *A45D 2200/05* (2013.01)

(58) Field of Classification Search
CPC ..... A45D 42/08; A45D 42/16
See application file for complete search history.

(56) References Cited

U.S. PATENT DOCUMENTS 1,833,436 A * 11/1931 Priest ..... A45D 27/04 132/290
1,889,496 A * 11/1932 Priest ..... A45D 27/28 132/290
2,958,329 A * 11/1960 Almgren ..... A45D 27/28 132/290
2002/0157683 A1* 10/2002 Gibbs ..... A45D 27/22 132/289
2004/0112401 A1* 6/2004 Riegel ..... A45D 27/28 132/291
2004/0188470 A1* 9/2004 Hill ..... A45D 42/16 222/192
2007/0075095 A1* 4/2007 Sherman ..... B65D 81/36 222/215
2015/0122755 A1* 5/2015 McGee ..... B65D 25/24 211/60.1
2015/0314464 A1* 11/2015 Guzak ..... B26B 21/52 30/41

FOREIGN PATENT DOCUMENTS

DE 2211330 A1 * 10/1973 ..... A45D 42/08
GB 2129682 A * 5/1984 ..... A45D 27/22

* cited by examiner

*Primary Examiner* — Daniel J Colilla

(57) ABSTRACT

A shaving mirror base to place onto the bottom of a shaving cream/gel container, comprising: an integral base, wherein the outside bottom of the integral base comprises a mirror; a side wall, wherein the side wall extends upwardly and terminates at an upper rim; and an open top, wherein the open top extends downwardly and inwardly from the side wall. The shaving mirror base may comprise a flat mirror or a convex mirror, and the mirror may further comprise anti-fog and water repellant properties. And, a manufacturing method for a shaving mirror base.

12 Claims, 16 Drawing Sheets

SHAVING MIRROR BASE

FIELD OF USE

The present disclosure relates generally to shaving mirrors. More specifically, the present disclosure relates to a shaving mirror base that is attachable to and readily removable from the bottom of a shaving cream/gel container and a method of manufacturing a shaving mirror base.

BACKGROUND

The practice of shaving facial hair with the combination of shaving cream/gel and a razor is an almost daily occurrence for many individuals. Effective shaving requires a mirror. Generally, most individuals shave in front of a mirror above the bathroom sink—a time-consuming and somewhat cumbersome task because it requires an individual to rinse the face with warm water prior to shaving, continually rinse the razor in the sink throughout the shaving process, rinse/clean off the face and razor after finishing, and also clean the area afterwards. Alternatively, shower mirrors currently in the market enable one to shave while in the shower, eliminating certain inefficiencies and the cumbersome nature of traditional shaving. However, shower mirrors can be awkward to use, unappealing, take up precious real estate in small showers, and be inconvenient to use. For example, existing support bases of shower mirrors, such as suction cups or wire frames, are poor quality at best and ineffective at worst. And, shower mirrors are often in the way and pose safety risks if dropped. As a result, any benefit gained from the use of existing shower mirrors is outweighed by its overall inconvenience.

Thus, what is needed is a new and improved shaving mirror that provides the benefits of a shower mirror without any of its common drawbacks or disadvantages. Ideally, such a shaving mirror is durable, convenient to use, reusable, requires no additional space for placement, and comprises a fogless, safe, high-resolution mirror.

SUMMARY

The following presents a simplified overview of the example embodiments in order to provide a basic understanding of some embodiments of the example embodiments. This overview is not an extensive overview of the example embodiments. It is intended to neither identify key or critical elements of the example embodiments nor delineate the scope of the appended claims. Its sole purpose is to present some concepts of the example embodiments in a simplified form as a prelude to the more detailed description that is presented herein below. It is to be understood that both the following general description and the following detailed description are exemplary and explanatory only and are not restrictive.

In accordance with the embodiments disclosed herein, the present disclosure is directed to a shaving mirror base that is attachable to and readily removable from the bottom of a shaving cream/gel container and a method of manufacturing a shaving mirror base. The shaving mirror base comprises: an integral base, wherein the outside bottom of the integral base comprises a mirror; a side wall, wherein the side wall extends upwardly and terminates at an upper rim; and an open top, wherein the open top extends downwardly and inwardly from the side wall. The shaving mirror base may comprise a flat mirror or a convex mirror, and the mirror may further comprise anti-fog and water repellant properties. The manufacturing method comprises encapsulating a mirror with an integral base; forming a side wall, wherein the side wall extends upwardly from the integral base and terminates at an upper rim; and forming an open top, wherein the open top extends downwardly and inwardly from the side wall.

Still other advantages, embodiments, and features of the subject disclosure will become readily apparent to those of ordinary skill in the art from the following description wherein there is shown and described a preferred embodiment of the present disclosure, simply by way of illustration of one of the best modes best suited to carry out the subject disclosure. As it will be realized, the present disclosure is capable of other different embodiments and its several details are capable of modifications in various obvious embodiments all without departing from, or limiting, the scope herein. Accordingly, the drawings and descriptions will be regarded as illustrative in nature and not as restrictive.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps that are illustrated. When the same numeral appears in different drawings, it refers to the same or like components or steps.

As shown in FIG. 16, the Base may comprise both an inward opening 1605 along the circumference of the inside wall of the Base within which the ridge of a container may fit and a protective layer of material 1610 above the mirror and below the inward opening 1605, upon which the bottom of a container can rest.

DETAILED DESCRIPTION OF THE ILLUSTRATIVE EMBODIMENTS

Before the present methods and systems are disclosed and described, it is to be understood that the methods and systems are not limited to specific methods, specific components, or to particular implementations. It is also to be understood that the terminology used herein is for the purpose of describing particular embodiments only and is not intended to be limiting. Various embodiments are described with reference to the drawings. In the following description, for purposes of explanation, numerous specific details are set forth in order to provide a thorough understanding of one or more embodiments. It may be evident, however, that the various embodiments may be practiced without these specific details. In other instances, well-known structures and devices are shown in block diagram form to facilitate describing these embodiments.

In accordance with the embodiments disclosed herein, the present disclosure is directed to a shaving mirror base to place onto the bottom of a shaving cream/gel container, comprising: an integral base, wherein the outside bottom of the integral base comprises a mirror; a side wall, wherein the side wall extends upwardly and terminates at an upper rim; and an open top, wherein the open top extends downwardly and inwardly from the side wall. The shaving mirror base may comprise a flat mirror or a convex mirror, and the mirror may further comprise anti-fog and water repellant properties. And, a manufacturing method for a shaving mirror base, wherein the manufacturing method comprises encapsulating a mirror with an integral base; forming a side wall, wherein the side wall extends upwardly from the integral base and terminates at an upper rim; and forming an open top, wherein the open top extends downwardly and inwardly from the side wall.

Figure 1:
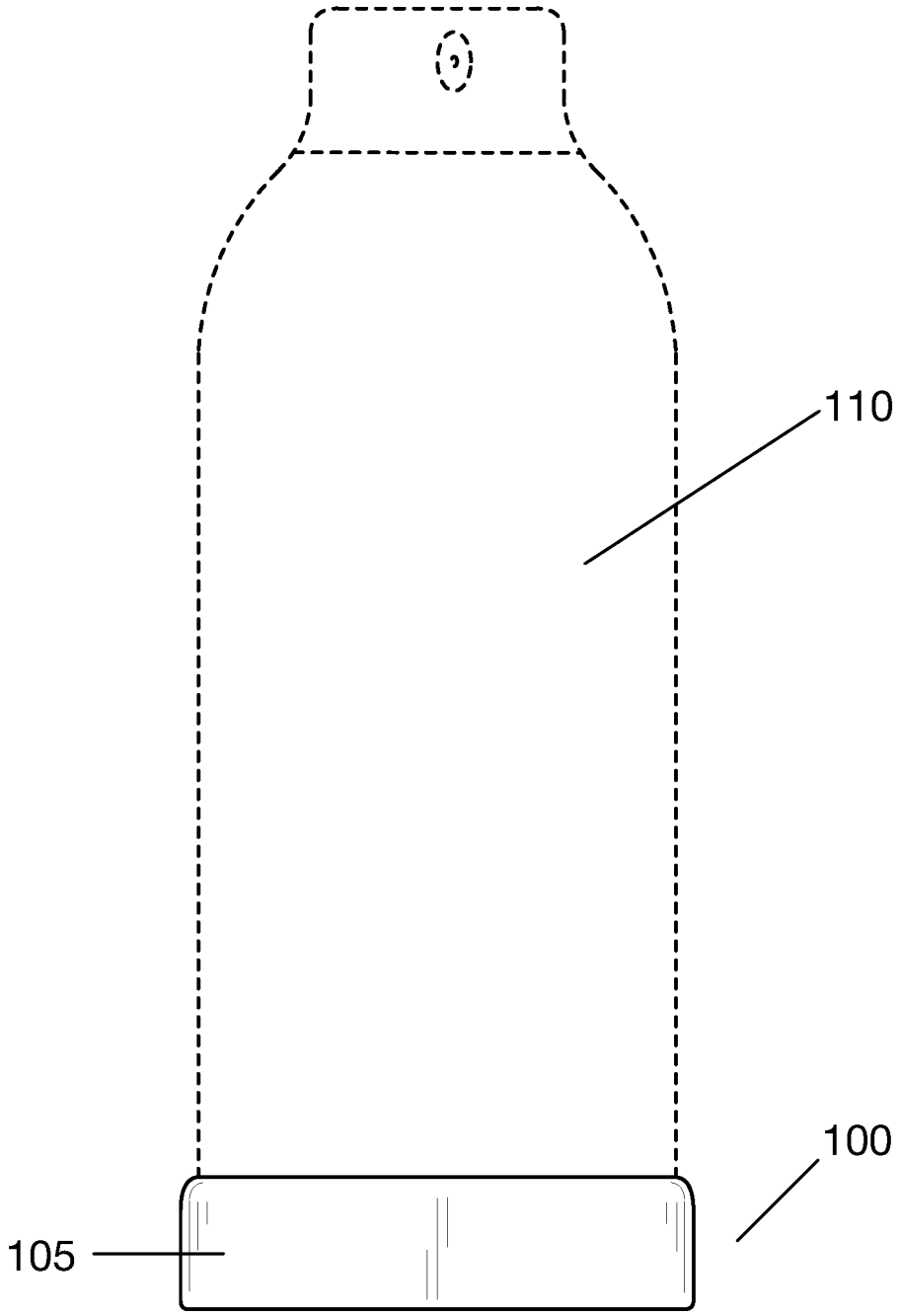
FIG. 1 generally illustrates an embodiment of a shaving mirror base.

FIG. 1 generally illustrates an embodiment of a shaving mirror base. As shown in FIG. 1, the shaving mirror base (referenced herein throughout the application as "Base" without reference to any one specific figure or embodiment) 100 comprises a circular-shaped apparatus with a solid wall 105 and an open top. The shape of the inside of the Base 100 is such that when it is placed onto the bottom of a shaving cream/gel container 110 (referenced herein throughout the application as "container" without reference to any one specific figure or embodiment), the inside of the wall 105 completely encompasses the sides of the container 110 and the bottom of the container 110 rests upon the inside of the Base 100. The Base 100 fits snuggly onto the container 110, wherein the Base 100 can be removed by an individual physically removing it from off the bottom of the container 110. When placed on the bottom of the container 110, the Base 100 provides additional support to the container 110, such that it can stand upright. Embodiments of the Base comprise various sizes, such as sizes that fit onto travel-size containers, wide-diameter containers, and slim-diameter containers.

The Base may be comprised of any material that enables the Base to retain its shape while being sufficiently flexible to fit onto the bottom of a container 110. Examples of material include but are not limited to polyurethane, silicone, and types of polyethylene. The material of the Base provides the additional benefits of preventing rust rings that can form from an exposed wet container and also reducing sliding of the container across a flat surface.

Figure 2:
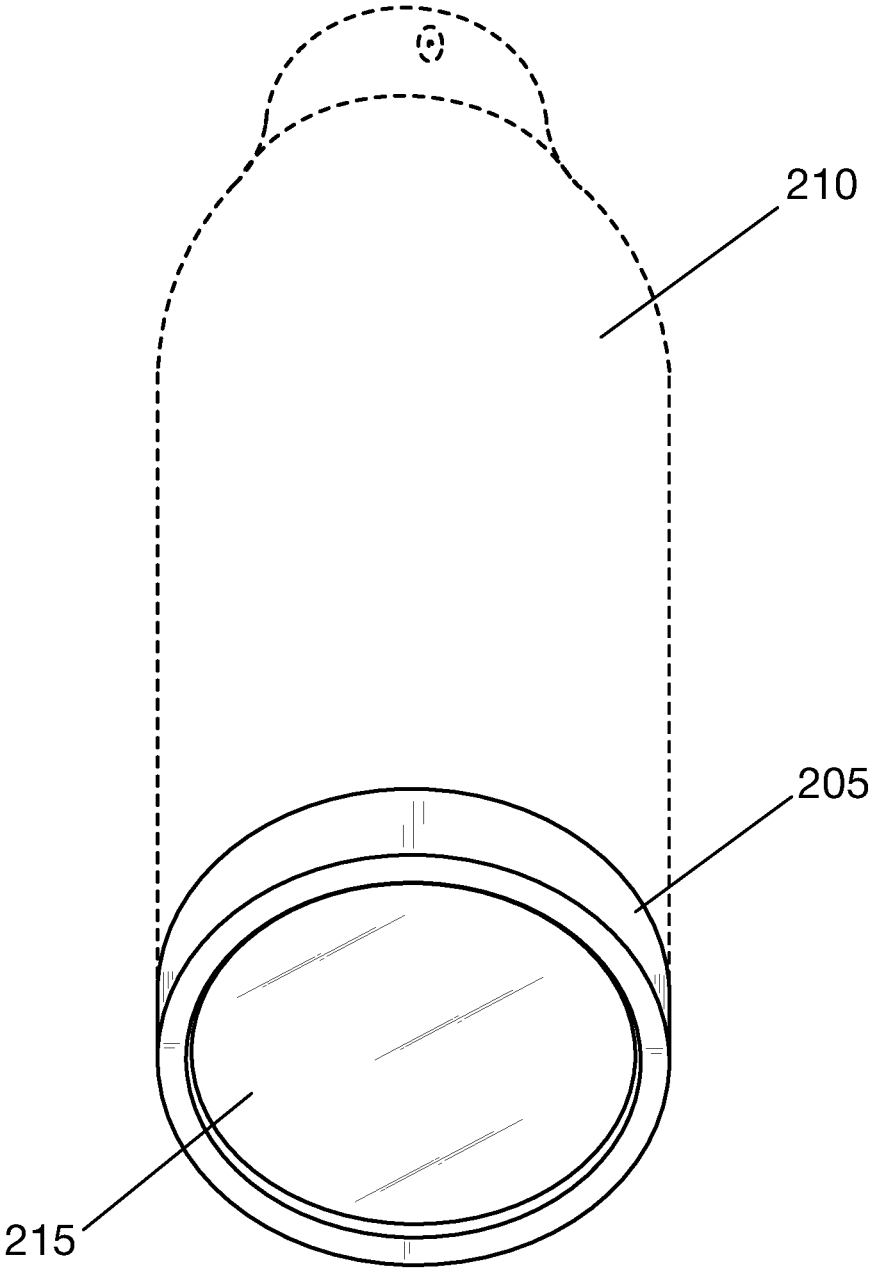
FIG. 2 generally illustrates an embodiment of a bottom perspective view of a shaving mirror base with a flat mirror.

FIG. 2 generally illustrates an embodiment of a bottom perspective view of a shaving mirror base with a flat mirror. As shown in FIG. 2, the inside of the wall 205 of the Base completely encompasses the sides of the container 210 with the bottom of the container 210 resting upon the inside of the Base and the Base fitting snuggly onto the container 210. The outside bottom of the Base comprises a mirror 215. The mirror 215 shown in FIG. 2 is a plane mirror, commonly referred to as a flat mirror. However, the Base may also comprise other embodiments of mirrors, such as convex mirrors. Embodiments of mirrors used allow for varying benefits. For example, convex mirrors allow for a wider, more encompassing reflection, while flat mirrors allow for a more focused reflection.

The Base may use mirrors made of a variety of material, such as fiberglass mirrors, aluminum glass mirrors, low aluminum glass mirrors, safety glass mirrors, silkscreen printed glass mirrors, and silver glass mirrors. Mirrors used by the Base may comprise features such as moisture/water resistant and anti-fog. These features allow an individual to shave without the image in the mirror being obscured.

Figure 3:
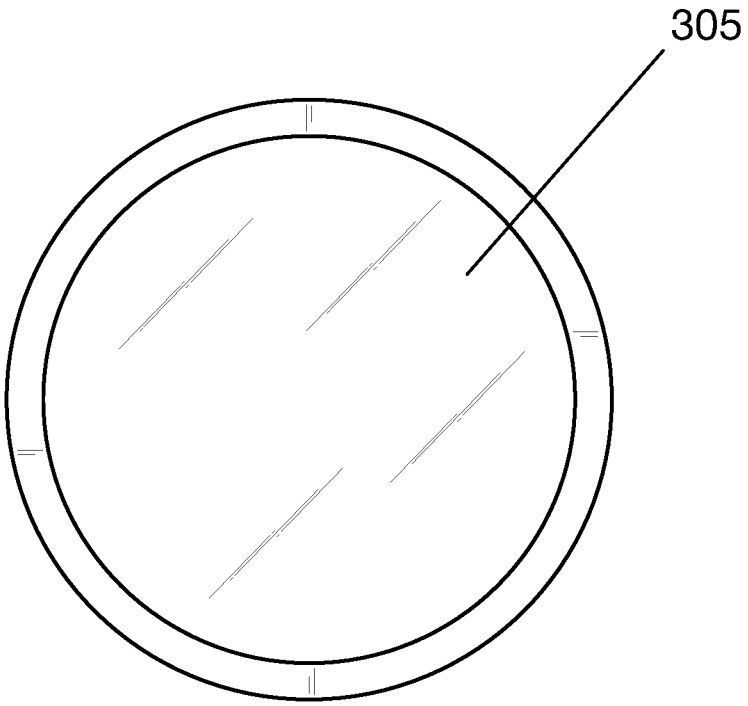
FIG. 3 generally illustrates an embodiment of a bottom view of a shaving mirror base with a mirror.

FIG. 3 generally illustrates an embodiment of a bottom view of a shaving mirror base with a mirror. As shown in FIG. 3, the bottom outside of the Base comprises a mirror 305. The mirror 305 is circular shaped. However, other embodiments may comprise a mirror with a different shape, such as a square, a star, a letter, a number, or an outline depicting the general shape of a desired image.

Figure 4:
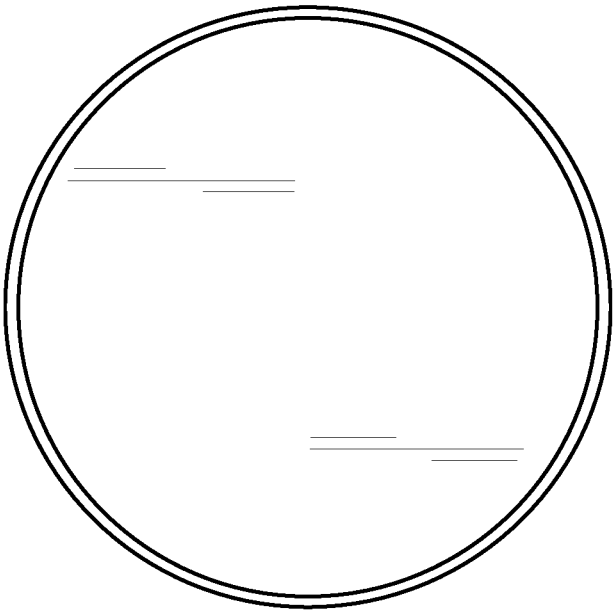
FIG. 4 generally illustrates an embodiment of a top perspective view of a shaving mirror base.

FIG. 4 generally illustrates an embodiment of a top view of a shaving mirror base.

Figure 5:
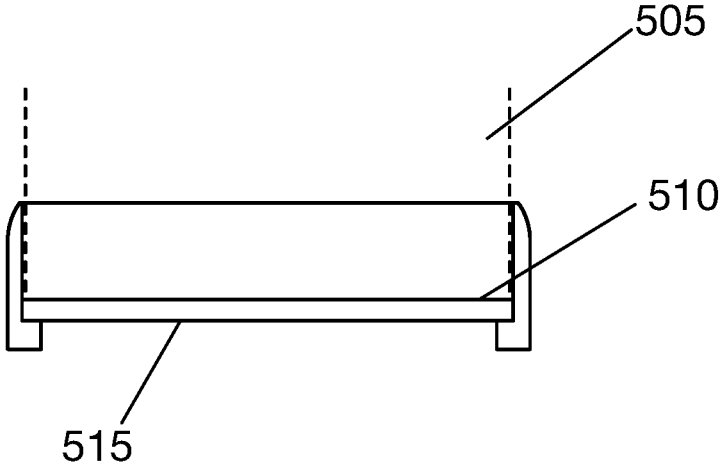
FIG. 5 generally illustrates an embodiment of a cross-sectional view of a shaving mirror base with a flat mirror.

FIG. 5 generally illustrates an embodiment of a cross-sectional view of a shaving mirror base with a flat mirror. As shown in FIG. 5, the container 505 sits flat against the inside bottom 510 of the Base, with the outside bottom of the Base having a mirror 515.

Figure 6:
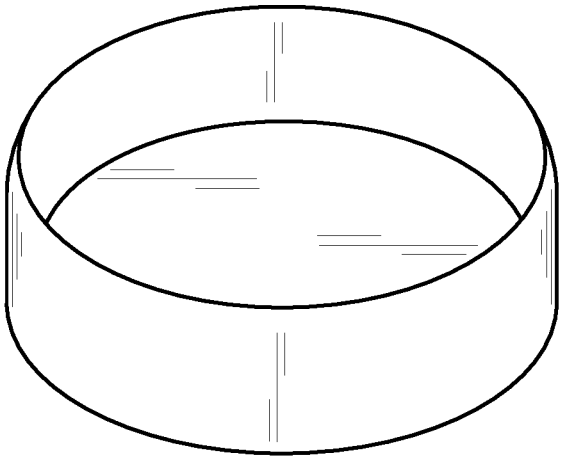
FIG. 6 generally illustrates an embodiment of a top perspective view of a shaving mirror base.

FIG. 6 generally illustrates an embodiment of a top perspective view of a shaving mirror base.

Figure 7:
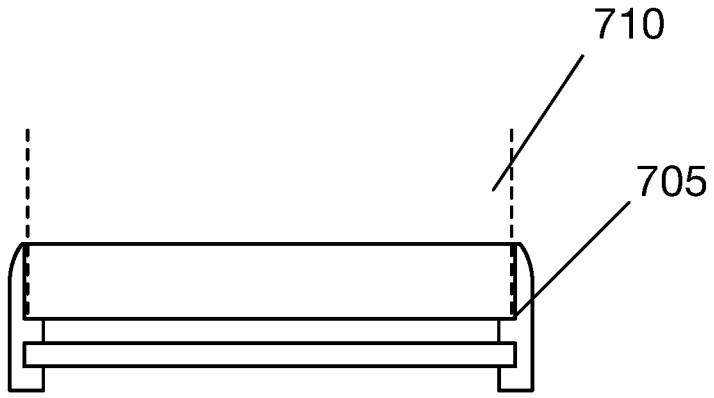
FIG. 7 generally illustrates an embodiment of a cross-sectional view of a shaving mirror base with a ridge/lip and a flat mirror.

FIG. 7 generally illustrates an embodiment of a cross-sectional view of a shaving mirror base with a ridge/lip and a flat mirror. As shown in FIG. 7, the Base may also comprise a lip/ridge 705 upon which a container 710 may rest, allowing for space between the container and the inside bottom of the Base.

Figure 8:
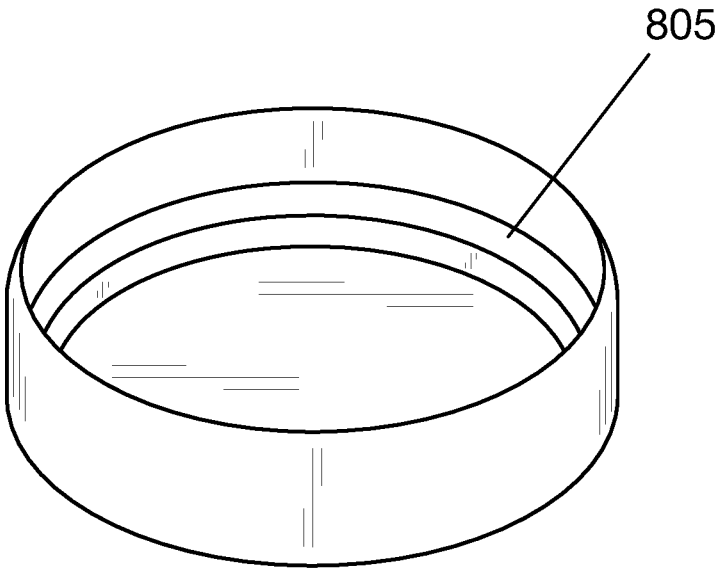
FIG. 8 generally illustrates an embodiment of a top perspective view of a shaving mirror base with a ridge/lip.

FIG. 8 generally illustrates an embodiment of a top perspective view of a shaving mirror base with a ridge/lip. As shown in FIG. 8, the Base may also comprise a lip/ridge 805 upon which a container may rest.

Figure 9:
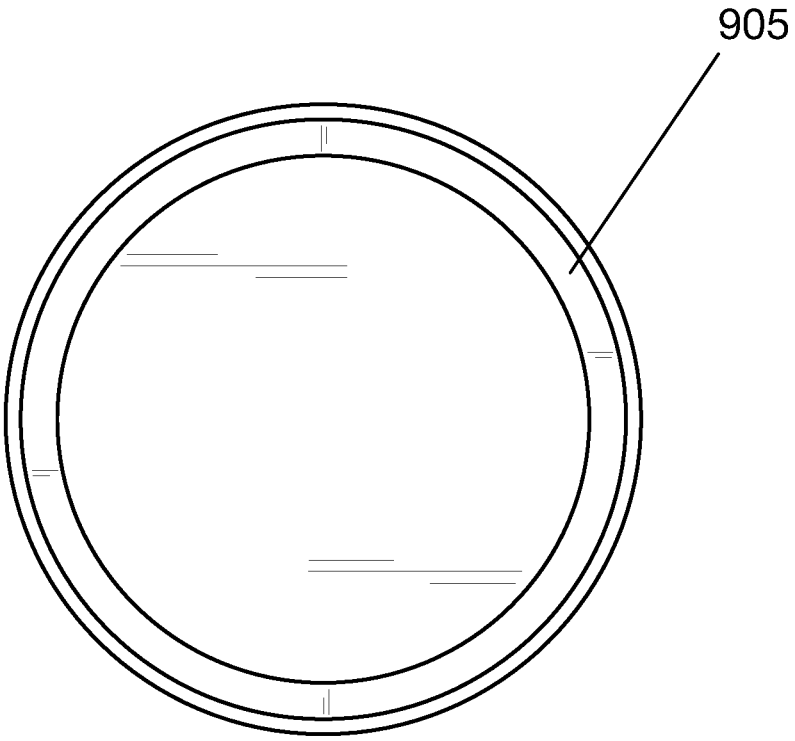
FIG. 9 generally illustrates an embodiment of a top view of a shaving mirror base with a ridge/lip.

FIG. 9 generally illustrates an embodiment of a top view of a shaving mirror base with a ridge/lip. As shown in FIG. 9, the Base may also comprise a lip/ridge 905 upon which a container may rest.

Figure 10:
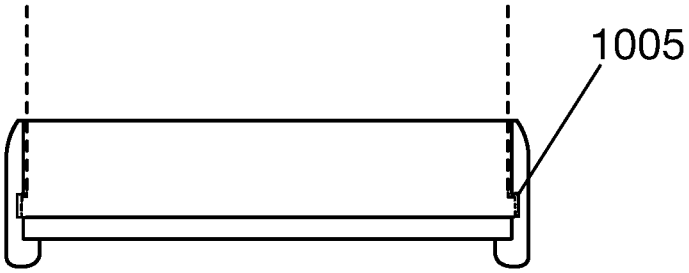
FIG. 10 generally illustrates an embodiment of a cross-sectional view of a shaving mirror base with a flat mirror.

FIG. 10 generally illustrates an embodiment of a cross-sectional view of a shaving mirror base with a flat mirror. As shown in FIG. 10, the Base may comprise an inward opening 1005 within which the ridge of a container may fit.

Figure 11:
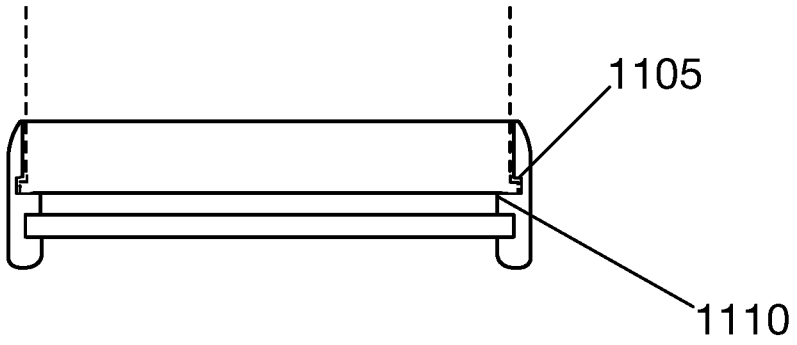
FIG. 11 generally illustrates an embodiment of a cross-sectional view of a shaving mirror base with a ridge/lip and a flat mirror.

FIG. 11 generally illustrates an embodiment of a cross-sectional view of a shaving mirror base with a ridge/lip and a flat mirror. As shown in FIG. 11, the Base may comprise both an inward opening 1105 within which the ridge of a container may fit and a ridge/lip 1110 upon which the bottom of a container can rest.

Figure 12:
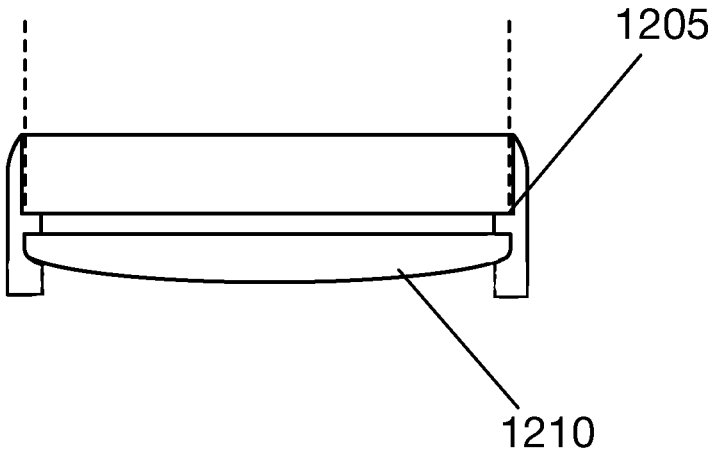
FIG. 12 generally illustrates an embodiment of a cross-sectional view of a shaving mirror base with a ridge/lip and a convex mirror.

FIG. 12 generally illustrates an embodiment of a cross-sectional view of a shaving mirror base with a ridge/lip and a convex mirror. As shown in FIG. 12, the Base may comprise a ridge/lip 1205 and a convex mirror 1210. The convex mirror is placed sufficiently within the Base such that it does not prevent the Base from sitting and standing on a flat surface.

Figure 13:
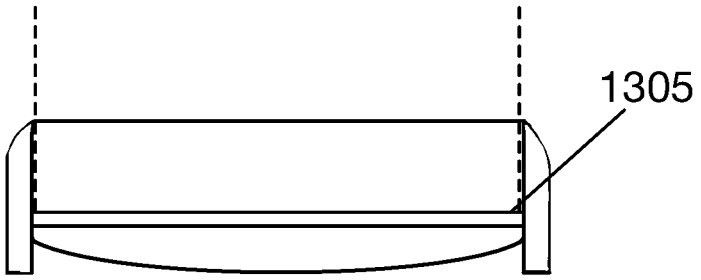
FIG. 13 generally illustrates an embodiment of a cross-sectional view of a shaving mirror base with a convex mirror.

FIG. 13 generally illustrates an embodiment of a cross-sectional view of a shaving mirror base with a convex mirror. As shown in FIG. 13, the Base may comprise a protective layer 1305 above the mirror, wherein the protective layer 1305 is made of the same material as the Base or may be made of a material different from the Base.

Figure 14:
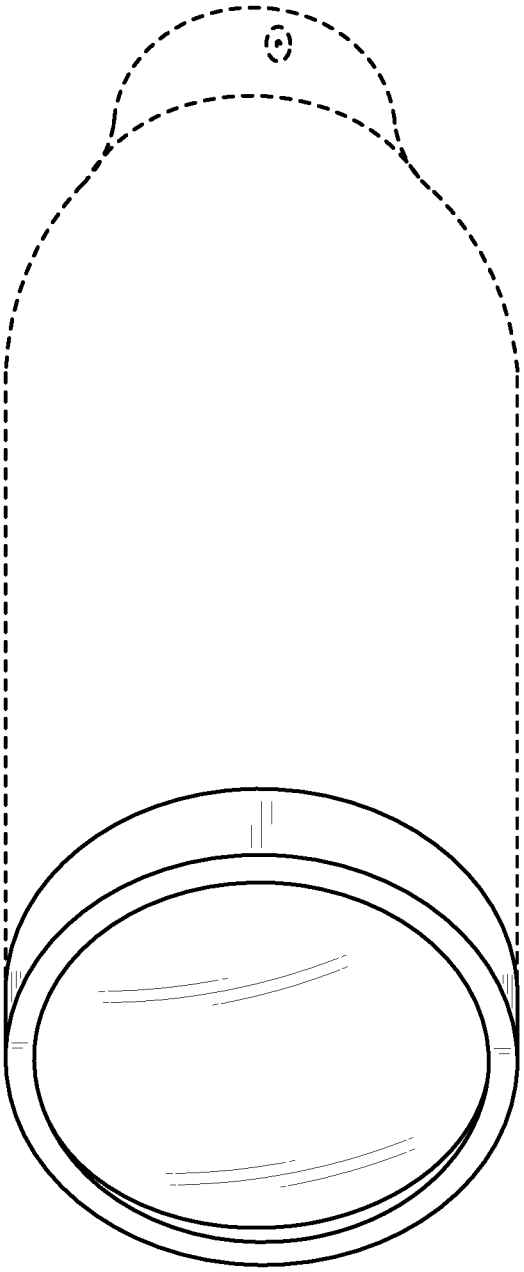
FIG. 14 generally illustrates an embodiment of a bottom perspective view of a shaving mirror base with a convex mirror.

FIG. 14 generally illustrates an embodiment of a bottom perspective view of a shaving mirror base with a convex mirror.

Figure 15:
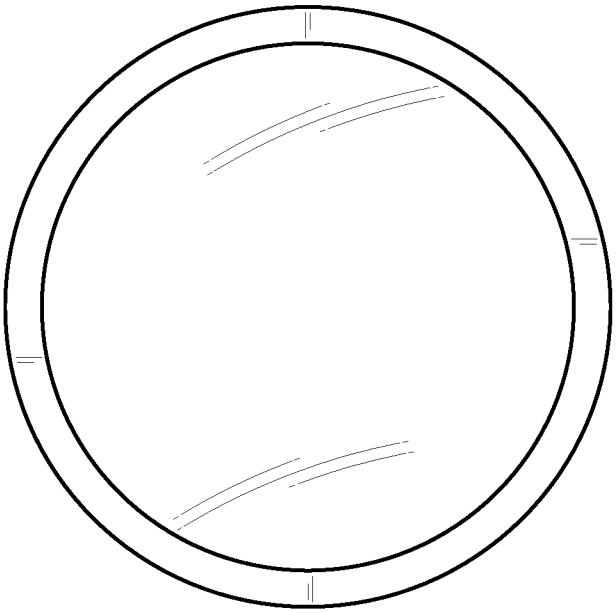
FIG. 15 generally illustrates an embodiment of a bottom view of a shaving mirror base with a convex mirror.
Figure 16:
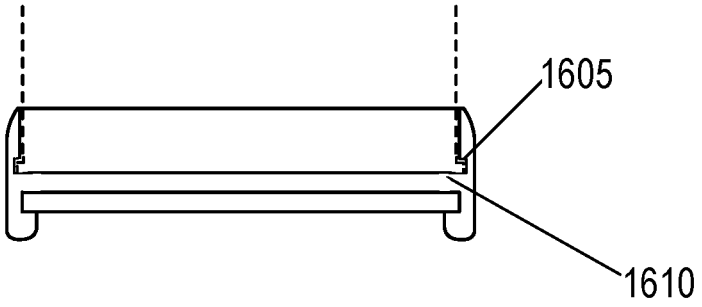
FIG. 16 generally illustrates an embodiment of a cross-sectional view of a shaving mirror base.

FIG. 15 generally illustrates an embodiment of a bottom view of a shaving mirror base with a convex mirror.

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order; it is in no way intended that an order be inferred, in any respect. This holds for any possible non-express basis for interpretation, including: matters of logic with respect to arrangement of steps or operational flow; plain meaning derived from grammatical organization or punctuation; the number or type of embodiments described in the specification.

What is claimed is:

1. A shaving mirror base to place onto the bottom of a shaving cream/gel container, comprising:

an open top and a bottom;

wherein the bottom comprises a mirror, wherein the mirror is recessed within the bottom;

a side wall, wherein the side wall has an outside and an inside, wherein an inward opening extends along the circumference of the inside of the side wall;

a protective layer of material, wherein the protective layer of material is positioned above the mirror and is directly below the inward opening extending along the circumference of the inside of the side wall, and wherein the protective layer of material is connected to the inside of the side wall;

wherein the open top is configured to attach to the bottom of the shaving cream/gel container;

wherein the protective layer of material is configured to support the bottom of the shaving cream/gel container; and wherein the inward opening extending along the circumference of the inside of the side wall is configured to engage with an edge of the bottom of the shaving cream/gel container.

2. The shaving mirror base of claim 1, wherein the mirror comprises one of: a flat mirror or a convex mirror.

3. The shaving mirror base of claim 1, wherein the mirror comprises one or both of the following attributes: anti-fog and water repellant.

4. The shaving mirror base of claim 1, wherein the shape of the mirror is one of the following: circle, square, or rectangle.

5. The shaving mirror base of claim 1, further comprising a ridge with a ninety degree angle, wherein the ridge extends the circumference of the bottom of the inside of the side wall.

6. The shaving mirror base of claim 1, wherein the shaving mirror base comprises one of the following materials: polyurethane, silicone, and a type of polyethylene.

7. A manufacturing method of a shaving mirror base to place onto the bottom of a shaving cream/gel container, comprising:

forming an open top and a bottom;

attaching a mirror to the bottom, wherein the mirror is recessed within the bottom;

forming a side wall, wherein the side wall has an outside and an inside, and forming an inward opening that extends along the circumference of the inside of the side wall;

attaching a protective layer of material to the inside of the side wall, wherein the protective layer of material is positioned above the mirror and directly below the inward opening extending along the circumference of the inside of the side wall;

wherein forming the open top comprises configuring the open top to attach to the bottom of the shaving cream/gel container;

configuring the protective layer of material to support the bottom of the shaving cream/gel container; and configuring the inward opening extending along the circumference of the inside of the side wall to engage with an outer edge of the bottom of the shaving cream/gel container.

8. The manufacturing method of claim 7, wherein the mirror comprises one of: a flat mirror or a convex mirror.

9. The manufacturing method of claim 7, wherein the mirror comprises one or both of the following attributes: anti-fog and water repellant.

10. The manufacturing method of claim 7, wherein the shape of the mirror is one of the following: circle, square, or rectangle.

11. The manufacturing method of claim 7, further comprising a ridge with a ninety degree angle, wherein the ridge extends the circumference of the bottom of the inside of the side wall.

12. The manufacturing method of claim 7, wherein the shaving mirror base comprises one of the following materials: polyurethane, silicone, and a type of polyethylene.

* * * * *